US005934314A

United States Patent [19]

Spear et al.

[11] Patent Number: 5,934,314

[45] Date of Patent: Aug. 10, 1999

[54] HOSE STORAGE DEVICE

[75] Inventors: Kenneth J. Spear, Vienna; Rudy F. Planthaber, Mineral Wells; Eric D. Bennett, Parkersburg, all of W. Va.; Steven F. Brooker, Marietta, Ohio

[73] Assignee: O. Ames Co., Parkersburg, W. Va.

[21] Appl. No.: 08/982,694

[22] Filed: Dec. 2, 1997

Related U.S. Application Data

[60] Provisional application No. 60/043,968, Apr. 22, 1997, and provisional application No. 60/032,219, Dec. 2, 1996.

[51] Int. Cl.[6] ..... B65H 75/34

[52] U.S. Cl. ..... 137/355.16

[58] Field of Search ..... 137/315, 355.16, 137/355.26, 355.27

[56] References Cited

U.S. PATENT DOCUMENTS

| | | | |
|---|---|---|---|
| Re. 32,510 | 9/1987 | Tisbo | 137/355.27 |
| 2,488,425 | 11/1949 | Morrone . | |
| 2,512,756 | 6/1950 | Wasserman . | |
| 4,137,939 | 2/1979 | Chow | 137/355.27 |
| 4,777,976 | 10/1988 | Johnston | 137/355.27 |
| 5,007,598 | 4/1991 | Spear et al. | 137/355.27 |
| 5,046,520 | 9/1991 | Sanchez, Jr. et al. | 137/355.27 |
| 5,056,553 | 10/1991 | Whitehead et al. | 137/355.27 |
| 5,381,981 | 1/1995 | Nelson | 137/355.27 |
| 5,425,391 | 6/1995 | Tisbo | 137/15 |
| 5,657,789 | 8/1997 | Tisbo et al. . | |
| 5,704,384 | 1/1998 | Tisbo et al. . | |

*Primary Examiner*—A. Michael Chambers
*Attorney, Agent, or Firm*—Pillsbury Madison & Sutro LLP

[57] ABSTRACT

The objective of the present invention is to provide a hose storage device that utilizes a supporting frame structure which is constructed and arranged to be nested on top of a similar supporting frame structure. The supporting frame structure is also constructed and arranged such that a similar supporting frame structure can be nested on top of the supporting frame structure. The hose storage device also has a hose reel structure having a surface for receiving a length of coiled hose thereon. The hose reel structure has generally circular end flanges. Also, the hose reel structure is rotatably mounted within the supporting frame structure. The aforementioned structures are constructed and arranged to allow a similar hose storage device to be stacked on top of the hose storage device with the supporting frame structure in a nesting relation with the supporting frame structure of the similar hose storage device. These structures have upwardly facing supporting surfaces constructed and arranged to support a similar hose storage device stacked in a nesting arrangement on top of the hose storage device. These structures also have downwardly facing stacking surfaces constructed and arranged to engage the upwardly facing supporting surfaces of a similar hose storage device when the hose storage device is stacked on top of the similar hose storage device.

24 Claims, 13 Drawing Sheets

HOSE STORAGE DEVICE

The present application claims priority benefit of U.S. Provisional Application Ser. No. 60/043,968, filed Apr. 22, 1997, and U.S. Provisional Application Ser. No. 60/032,219, filed Dec. 2, 1996.

The present invention relates to hose storage devices and more particularly to hose storage devices of the stackable type.

BACKGROUND OF THE INVENTION

Hose storage devices have been historically sold as a packaged product requiring assembly of a multiplicity of separate parts or sub-assemblies within a carton. Packaging optimized the transportation and storage of the product for the maker and seller, particularly since the task of assembly was left to the buyer to perform. Clearly, the buyer would prefer to purchase a fully assembled unit without having to pay a separate fee for assembly.

Assembly of the product by the maker destroys the transportation and storage optimization inherent in conventional packaging. U.S. Pat. No. 5,425,391 discloses a hose storage device structure which attempts to alleviate the transportation and storage problem which comes with full product assembly by the maker. Specifically, the devices were made stackable in a nesting relation by constructing the hose reel structure with oblong end flanges enabling the nested stack to have a greater product density per unit height. The oblong end flange construction provides disadvantages as compared with a conventional circular end flange construction. The irregular shape of the oblong end flanges on the hose cart taught in the '391 patent makes it difficult to roll or unroll a length of hose. Lateral movement of the hose when unrolling or rolling up the hose can cause the hose to extend over the shorter side of the oblong end flange. The hose can then become entangled with the higher side of the oblong end flange as the hose reel structure rotates. This situation does not occur with generally circular hose reel end flanges because the edge of the flange is generally the same radial distance from the hose reel structure surface at any given point. The oblong end flanges, however, are vital to the '391 hose cart because the cart will not stack with other similar hose carts in a nesting arrangement without the oblong end flanges. There exists a need to provide a stackable hose storage device which provides a highly desirable stacking height and at the same time retains the conventional circular end flanges in the hose reel structure.

BRIEF DESCRIPTION OF THE INVENTION

An object of the present invention is to fulfill the need expressed above. In accordance with the principles of the present invention, this objective is achieved by providing a hose storage device comprising a supporting frame structure. The supporting frame structure is constructed and arranged (1) to be nested on top of a similar supporting frame structure and (2) such that a similar supporting frame structure can be nested on top of the supporting frame structure. A hose reel structure has a hub structure constructed and arranged to receive a length of hose coiled thereon. The hose reel structure has generally circular end flanges on opposite sides of the hub structure and is rotatably mounted on the supporting frame structure. The structures have upwardly facing supporting surfaces constructed and arranged to support a similar hose storage device stacked on top of the hose storage device in a nesting relation wherein the similar supporting frame structure of the similar hose storage device nests on the supporting frame structure and upper portions of the circular end frames are disposed in transversely offset and overlapped relation with lower portions of similar circular end frames of the similar hose storage device. The structures have downwardly facing stacking surfaces constructed and arranged to engage similar upwardly facing supporting surfaces of a similar hose storage device when the hose storage device is stacked on top of the similar hose storage device in a nesting relation wherein the supporting frame structure nests on the similar supporting frame structure of the similar hose storage device and lower portions of the circular end frames are disposed in transversely offset and overlapped relation with upper portions of the similar circular end frames of the similar hose storage device.

DETAILED DESCRIPTION OF THE PRESENTLY PREFERRED EMBODIMENT

Figure 1:
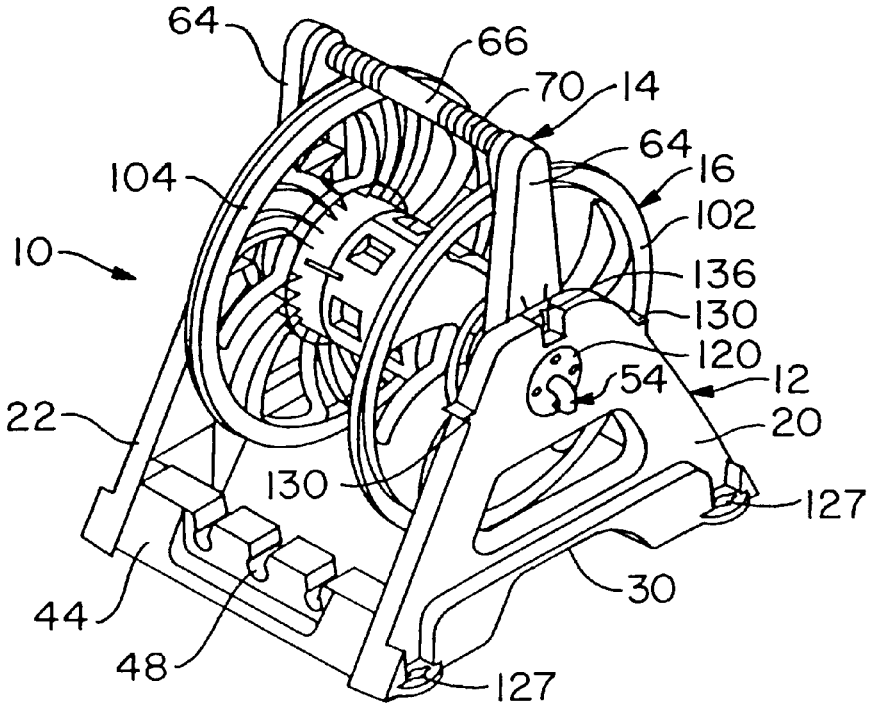
FIG. 1 is a perspective view of a hose storage device embodying the principles of the present invention.
Figure 2:
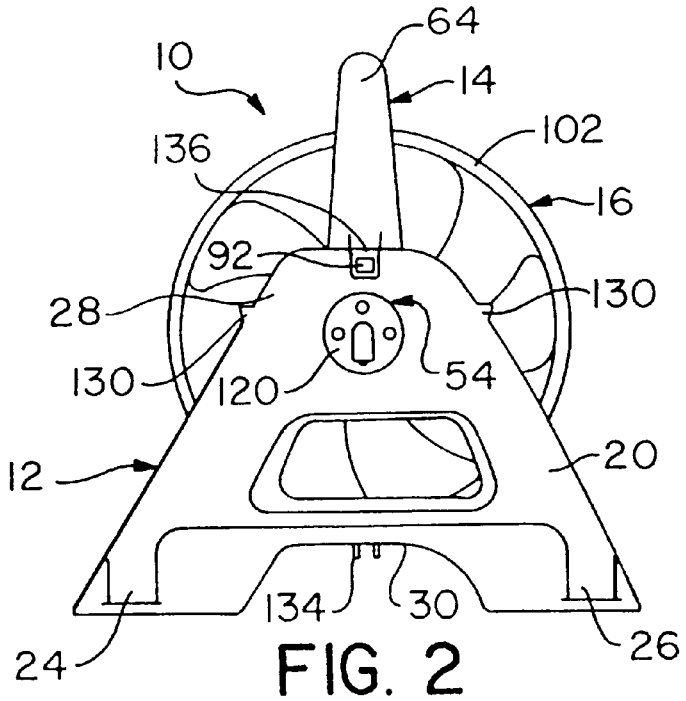
FIG. 2 is a side elevational view of the hose storage device viewed toward the right side with the water inlet pipe.
Figure 3:
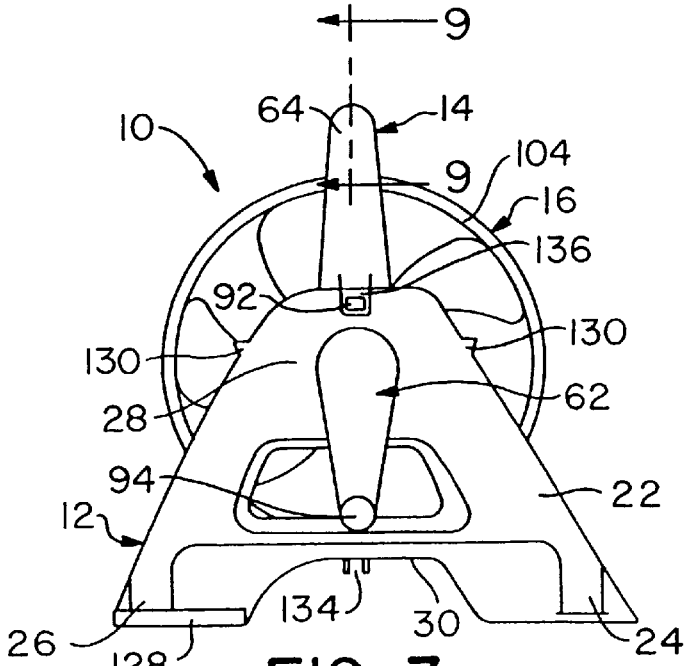
FIG. 3 is a side elevational view of the hose storage device viewed toward the left side with the hand crank structure.
Figure 4:
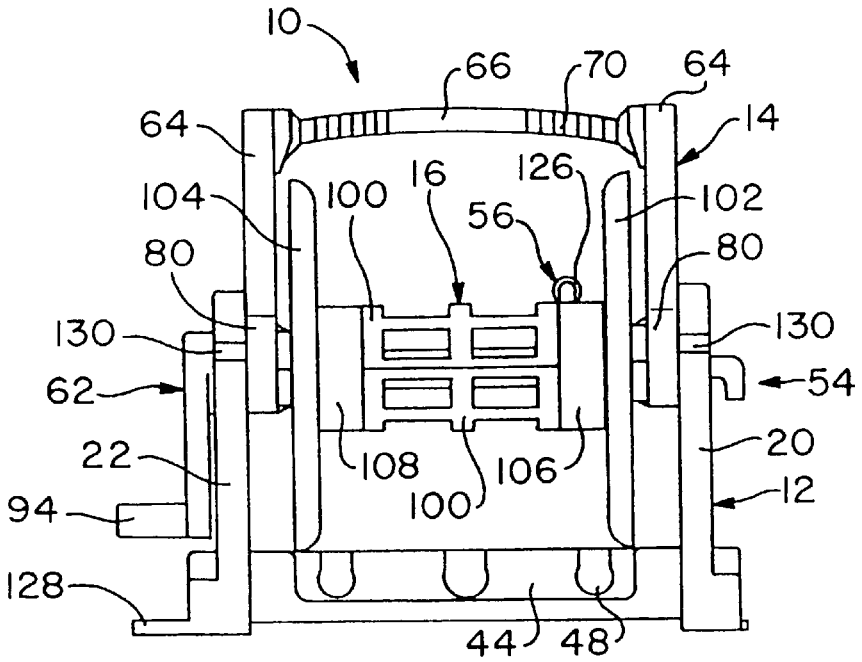
FIG. 4 is a rear elevational view of the hose storage device.
Figure 5:
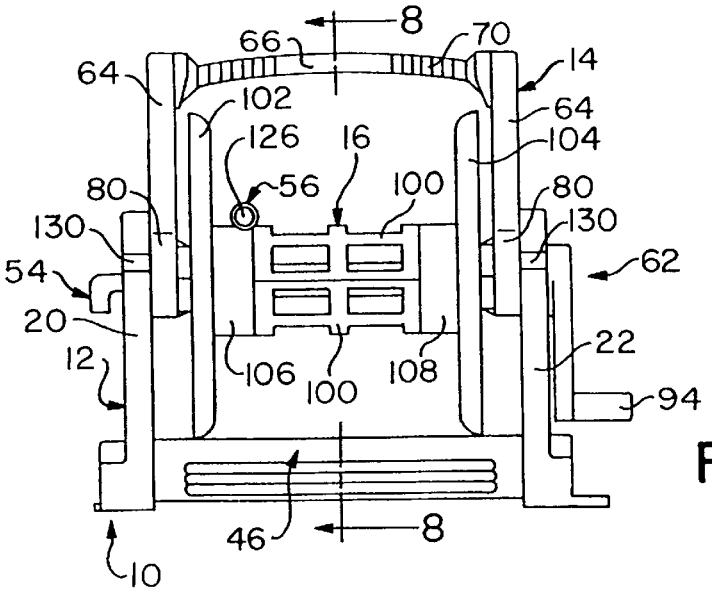
FIG. 5 is a front elevational view of the hose storage device.
Figure 6:
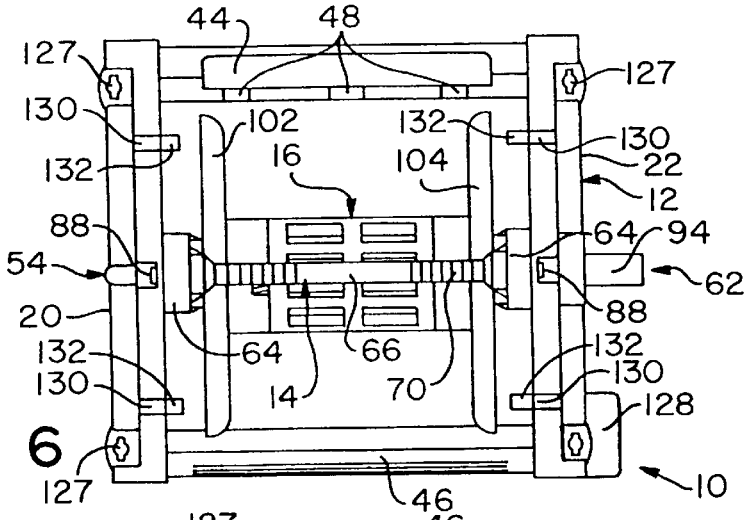
FIG. 6 is a top plan view of the hose storage device.

Referring now more particularly to the drawings, there is shown therein a hose storage device, generally indicated at 10, which embodies the principles of the present invention. The hose storage device 10 in general comprises a supporting frame structure, generally indicated at 12, a handle structure, generally indicated at 14, and a hose reel structure, generally indicated at 16.

The supporting frame structure 12 includes a pair of molded plastic side frame structures 20 and 22 shaped into a generally triangular configuration. This triangular configuration forms in the side frames three corner structures, namely, rear corner structure 24, front corner structure 26, and upper corner structure 28. The side frames 20 and 22 are generally mirror images of each other.

Figure 10:
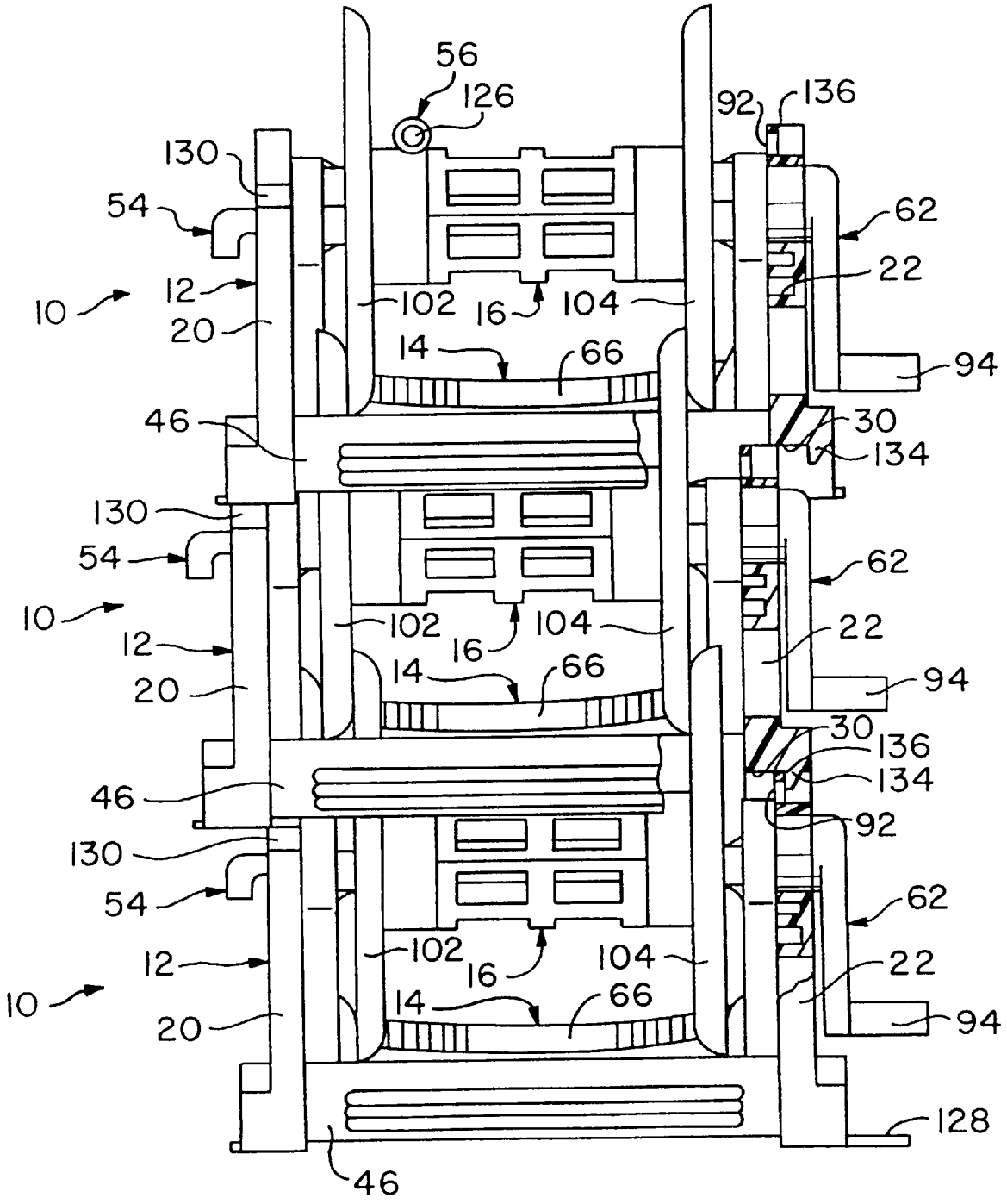
FIG. 10 is a front elevational view with parts broken away showing three hose storage devices stacked in a nesting relation in accordance with the principles of the present invention.

The bottom portion of each side frame 20 and 22, extending from the rear corner structure 24 to the front corner structure 26, has an upward recess 30 in the center. The upward recess 30 is designed to nest upon the upper corner structure 28 of a similar side frame when the hose storage device 10 is stacked in a nesting relation on top of a similar hose storage device as shown in FIG. 10.

Figure 11:
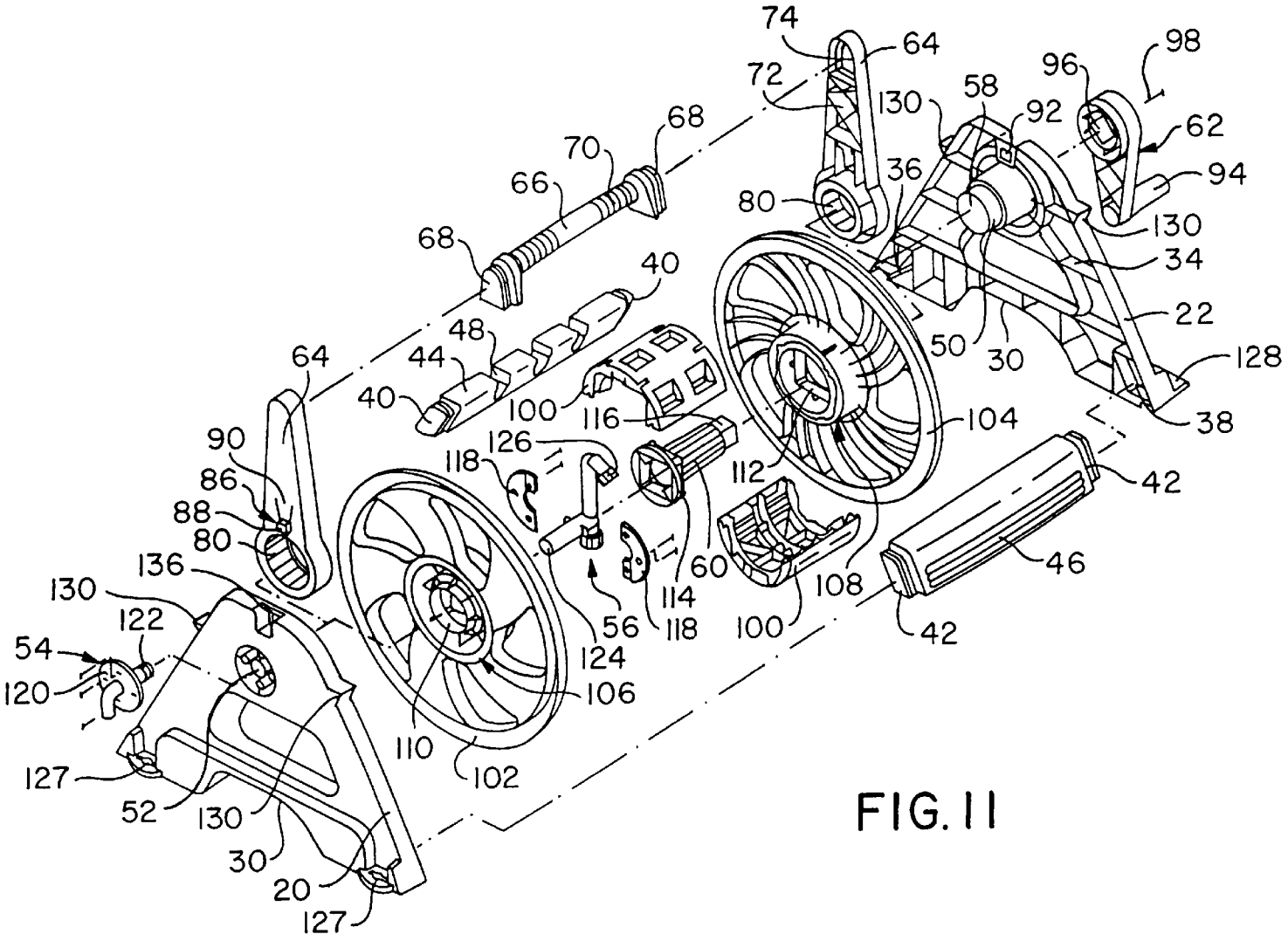
FIG. 11 is an exploded view of the hose storage device.
Figure 12:
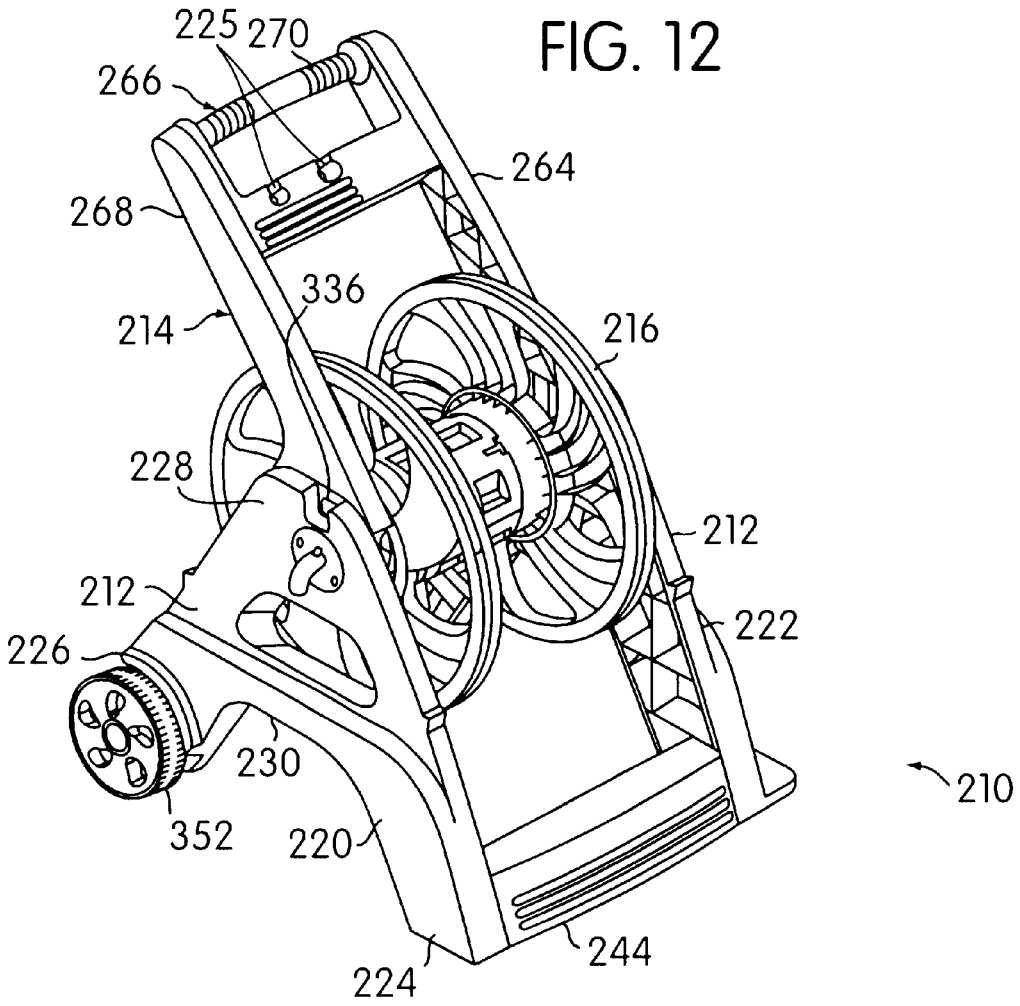
FIG. 12 is a perspective view of a hose storage cart according to a second embodiment embodying the principles of the present invention.

Each of the side frames 20 and 22 have a generally channel-shaped configuration with strengthening ribs 34 on the interior as best shown in FIG. 11. The channel-shaped configurations of the side frames 20 and 22 open towards one another.

The rear corner structure 24 of each side frame 20 or 22 has a socket structure 36 opening in a direction towards the corresponding socket structure 36 on the other side frame 20 or 22. A socket structure 38 opening in a direction towards a corresponding socket structure 38 on the other side frame 20 or 22 is also found on the front corner structure 26 of each side frame 20 or 22. The socket structures 36 and 38 on the rear and front corner structures 24 and 26 are designed to receive and fit snugly the closed end portions 40 and 42 of each of two rear and front transverse frame members 44 and 46.

The transverse frame members 44 and 46 are made of plastic and are preferably formed by blow molding. The rear transverse member 44 has notches 48 designed to retain the end of a hose. Blow molding gives the transverse members 44 and 46 hollow center portions with closed end portions 40 and 42. The closed end portions 40 and 42 have grooves extending around their peripheries. The socket structures 36 and 38 have ribs on their interiors. These ribs interlock with the grooves on the closed end portions 40 and 42 of the transverse frame members 44 and 46 when the closed end portions 40 and 42 are inserted into the associated socket structures 36 and 38. When all the closed end portions of the transverse frame members 44 and 46 are retained in a snugly fitting relation with the associated socket structure 36 and 38, the side frames 20 and 22 and the transverse frame members 44 and 46 constitute the supporting frame structure 12. The bottom of the supporting frame structure 12 is void of wheels, thus allowing the supporting frame structure 12 to engage the ground in a non-wheeled relation when the hose storage device 10 is disposed upon the ground or other horizontal surface.

The inner surface of each side frame 20 or 22 has a hub 50 designed to rotatably support the hose reel structure 16 and the handle structure 14 connected therewith to the supporting frame structure 12. The hub 50 on the inlet-side side frame 20 has a hole 52 through which a water inlet pipe 54 can be rotatably and fluidly connected to a water outlet pipe 56 carried by the hose reel structure 16. The crank-side side frame 22 has a hole through which a rotatable shaft 60 can engage the hose reel structure 16 and the hand crank structure 62.

The handle structure 14 includes side legs 64 and a transverse member 66. The transverse member 66 is formed of plastic by blow molding. Blow molding gives the transverse handle member 66 a hollow center portion with closed end portions 68. The transverse handle member 66 also has a hand grip portion 70 formed by molding a pattern into the plastic in order to facilitate gripping.

Figure 9:
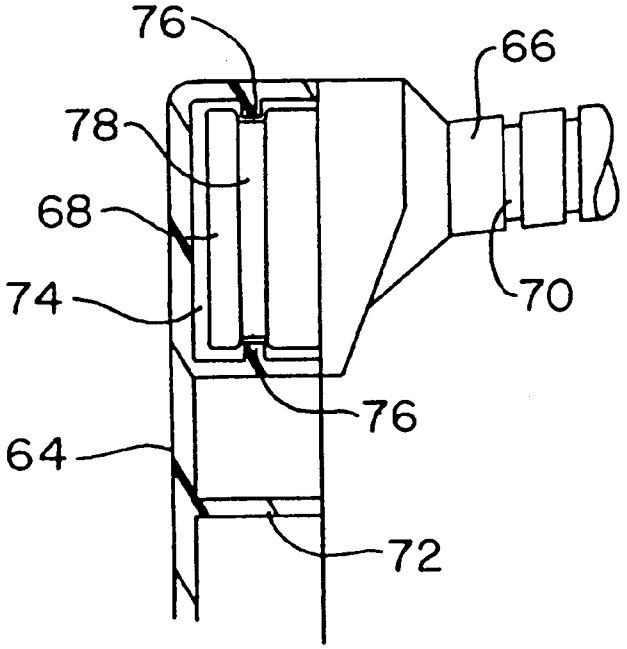
FIG. 9 is a cross-sectional view taken along the line 9—9 of FIG. 3.

The side legs 64 are made of plastic and have a generally channel-shaped configuration with strengthening ribs 72 on the interior. The side legs 64 have socket structures 74 on the inside surface. The top and bottom surfaces of the interior of the socket structure 74 have ribs 76 extending inward. As best shown in FIG. 9, each closed end portion 68 of the transverse handle member 66 has a groove 78 extending around the periphery. The grooves 78 and the ribs 76 are designed to interlock with each other when the closed end portion 68 of the transverse member 66 is inserted into the socket structure 74. Thus, the closed end portions 68 of the transverse members 66 are retained in a snugly fitting relation with the socket structures 74 located on the inside surface of the side legs 64.

A circular ring 80 is formed integral with the bottom of each side leg 64. The circular rings 80 are designed to fit onto the hubs 50 extending inward from the side frames 20 and 22 and be retained thereon by end flanges 102 and 104 of the hose reel structure 16. In this way, the handle structure 14 is movably connected to the supporting frame structure 12. The handle structure 14 is movable from a stacking position extending generally downward coextensive with the supporting frame structure 12 to a carrying position extending upward from the supporting frame structure 12, so that the hand grip portion 70 is disposed above the supporting frame structure 12.

The side legs 64 also have locking mechanisms 86 located thereon. Each locking mechanism 86 is a tab 90 formed integrally within the outwardly facing wall of the side leg 64 with a square protrusion 88 extending outward from the tab 90. A square opening 92 is located on the top of each side frame 20 and 22. Each square opening 92 is on an outwardly facing restraining surface 136 at the upper corner 28 of the side frames 20 and 22. The square protrusions 88 engage the side frame 20 and 22 as the handle structure 14 is rotated from the stacking position to the carrying position and the locking mechanisms 86 are folded inward into the side legs 64. When the handle structure 14 reaches the carrying position, the square protrusions 88 reach the square openings 92. Each locking mechanism 86 unfolds and the square protrusions 88 fit within the square openings 92. In this way, the handle structure 14 is secured in the carrying position by the locking mechanisms 86. The locking mechanisms 86 are disengaged by pushing the square protrusions 88 out of the square openings 92 such that the locking mechanisms 86 are folded backwards into the side legs 64. The handle structure 14 can then be rotated down to the stacking position.

A hand crank structure, generally indicated at 62, turns the hose reel structure 16. The molded plastic hand crank structure 62 has a handle 94 and a socket structure 96. The socket structure 96 has a square shape within which the end of a rotatable shaft 60 forming a part of the hose reel structure 16 is received. A fastener 98 fixes the hand crank structure 62 to the rotatable shaft 60.

Preferably, the hose reel structure 16 utilizes two semi-cylindrical hub sections 100, two circular end flanges 102 and 104, a water outlet pipe 56, a rotatable, fluid connection between the inlet pipe 54 and the outlet pipe 56, and a rotatable shaft 60. It is not necessary that the end flanges 102 and 104 be circular. End flanges with shapes that are generally circular, such as a hexagon or an octagon, are acceptable, although circular end flanges 102 and 104 are preferred. The specific manner in which the hose reel structure is assembled is taught in U.S. Pat. No. 5,007,598.

The circular end flanges 102 and 104 are made of molded plastic with hub sections 106 and 108 and spokes extending outward to circular rims. The diameter of the circular end flanges 102 and 104 is great enough that when the hose reel structure 16 is rotatably mounted within the supporting frame structure 12, portions of the circular end flanges 102 and 104 are above the highest point of the supporting frame structure 12. A notch on the hub 106 on the inlet-side end flange 102 allows the water outlet pipe 56 to be rotated fixedly with the surface of the hose reel structure 16. The hub 106 of the inlet-side end flange 102 also has a circular opening 110 allowing it to be rotatably mounted on a hub 50 extending inward from the side frame 20. The crank-side end flange 104 has a circular opening 110 in the hub 108 allowing it to be rotatably mounted on a hub 50 extending inward from the side frame 22. The inside of the crank-side end flange 104 has a squared opening 112 designed to receive the squared base 114 of the rotatable shaft 60.

The semi-cylindrical hub sections 100 are made of molded plastic and designed to interlock with each other and form a cylindrical hub section. They are also designed to engage with surfaces of the inside hubs 106 and 108 of the circular end flanges 102 and 104 in order to form the hose reel structure 16. This cylindrical hub section is responsible for bearing the coiled length of hose. In this way, the hose reel structure 16 is designed to be capable of bearing the load of a substantial length of hose and contained water and to have a surface capable of engaging the hose as the hose reel structure 16 is rotated.

A rotatable shaft 60 of molded plastic is used to engage the crank-side circular end flange 104 and the hand crank structure 62, thereby rotating the hose reel structure 16 as the hand crank structure 62 is turned. The rotatable shaft 60 is cylindrical with a square end 116 for engaging the hand crank structure 62 and a square base 114 for engaging the crank-side end flange 104.

The inlet-side end flange 102 is first rotatably mounted on the hub 50 extending inward from the inlet-side side frame 20. The water outlet pipe 56 is rotatably mounted by fluidly connecting it to the water inlet pipe 54 and aligning it in the notch on the inlet-side end flange 102. A two-piece gasket 118, secured by fasteners to the hub 50 extending inward from the inlet-side side frame 20, holds the outlet pipe 56 in connection with the inlet pipe 54. The gasket 118 also secures the inlet-side end flange 102 to the hub 50 extending inward from the side frame 20, but allows the inlet-side end flange 102 to rotate freely.

The two semi-cylindrical hub sections 100 are joined together to form a cylindrical hub section. This cylindrical hub section engages the inlet-side end flange 102 such that the center line of the cylindrical hub section is perpendicular to the end flange 102. The squared base 114 of the rotatable shaft 60 is engaged with the squared opening in the crank-side end flange 104. The crank-side end flange 104, now engaged with the rotatable shaft 60, is joined to the end of the cylindrical hub section. The circular opening 110 on the hub 108 section of the crank side end flange 104 is then mounted on the hub 50 extending inward from the crank-side side frame 22. By engaging the squared end 116 of the rotatable shaft 60 with the squared socket structure 96 of the hand crank 62 and securing it thereto with a fastener 98, the hose reel structure 16 is rotatably mounted within the supporting frame structure 12 with a portion of the circular end flanges 102 and 104 above the highest point of the supporting frame structure 12.

Water flows from a water source through the inlet 54 and outlet pipes 56. The inlet pipe 54 is formed of molded plastic and has a ninety-degree bend near one end and a flange 120 near the bend. The end 122 opposite the bend and flange 120 has ribs allowing it to create a seal when inserted into the outlet pipe 56. The inlet pipe 54 fits in the hole 52 in the third corner structure 28 of the inlet-side side frame 20 and extends into the hub 50 on which the hose reel structure 16 is rotatably mounted. Fasteners attaching the flange 120 to the inlet-side side frame 20 secure the inlet pipe 54 in a fixed position. A flexible hose can be secured by a clamp to the end of the inlet pipe 54 with the ninety degree bend. This hose can then be connected to a water supply.

The outlet pipe 56 is mounted in the notch on the inlet-side end flange 102. A receiving end 124 is rotatably and fluidly connected to the inlet pipe 54 by inserting the ribbed end 122 of the inlet pipe 54 into the receiving end 124 of the outlet pipe 56. A hose can be connected to the male connector 126 found on the end of the outlet pipe 56. A 90° bend in the outlet pipe 56 allows the receiving end 124 of the outlet pipe 56 to be fluidly and rotatably connected with the inlet pipe 54 while the end with the male connector 126 extends radially from the surface of the hose reel structure 16. This arrangement allows the outlet pipe 56 to rotate fixedly with the hose reel structure 16 surface. The outlet pipe 56 also bends near the end with the male connector 126 to facilitate connection with a hose.

The rear and front corner structures 24 and 26 on each side frame 20 and 22 have mounting structures 127. These mounting structures 127 are constructed and arranged to mount the hose storage device 10 to a wall. The mounting structures 127 are flat surfaces integral with the bottom of each side frame 20 and 22 with holes through which a fastener such as a nail or a screw can be received. The fasteners are passed through the holes in the mounting structures 127 and attached to a wall, thereby mounting the hose storage device 10 on the wall. A platform 128 integral with the bottom of the side frame 22 extends outward from the second corner structure 26 on the crank-side side frame 22. The mounting structure 127 on the front corner structure 26 of the crank-side side frame 22 is located on the platform 128. A user can place his foot on the platform 128 while turning the hand crank structure 62 in order to keep the bottom of the hose storage device 10 engaged with the ground.

In the presently preferred embodiment of the invention, upwardly facing supporting surfaces 130 are located on the front and back edges of each side frame 20 and 22. The upwardly facing supporting surfaces 130 are aligned horizontally and are in the form of ridges extending from and integrally formed with the side frames 20 and 22. The upwardly facing surfaces 130 are aligned such that they support the weight of a similar hose storage device 10 stacked in an offset nesting arrangement on top of the hose storage device 10 as shown in FIG. 10.

Figure 7:
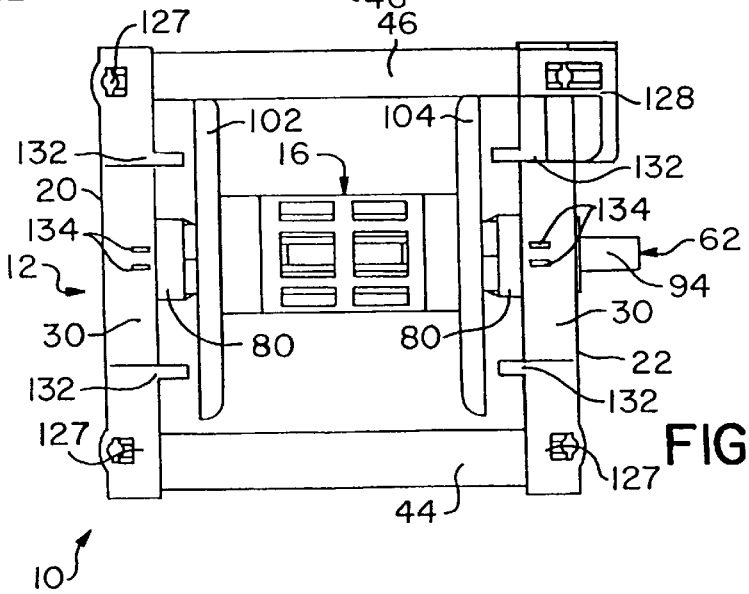
FIG. 7 is a bottom plan view of the hose storage device.
Figure 8:
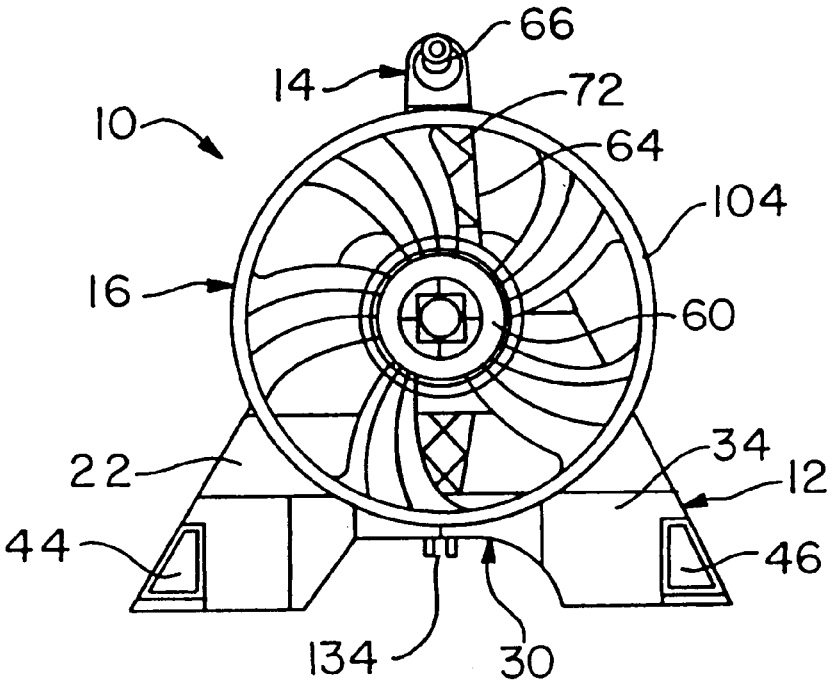
FIG. 8 is a cross-sectional view of the hose storage device taken along the line 8—8 of FIG. 5.

The supporting frame structure 12 also includes downwardly facing stacking surfaces 132 which, as shown, are those surfaces on the bottom of the hose storage device 10 that rest on the upwardly facing supporting surfaces 130 of a similar hose storage device when the hose storage device 10 is stacked in an offset nesting arrangement on top of the similar hose storage device. As best shown in FIG. 7, these downwardly facing stacking surfaces 132 also extend inward from the side frames 20 and 22. When the hose storage device 10 is stacked in an offset nesting arrangement on top of a similar hose storage device, as shown in FIG. 10, the portions of the downwardly facing stacking surfaces 132 extending inward from one side frame 22 are supported by the upwardly facing supporting surfaces 130 of the similar hose storage device. Also, the portions of the downwardly facing stacking surfaces 132 that do not extend inward from the other side frame 20 are similarly supported by the upwardly facing supporting surfaces 130 of the similar hose storage device.

Preferably, the hose storage device 10 has inwardly facing restraining surfaces 134 and outwardly facing restraining surfaces 136. The purpose of the inwardly and outwardly facing restraining surfaces 134 and 136 is to restrict lateral movement of the hose storage device 10 when it is stacked in an offset nesting arrangement on top of or below similar hose storage devices. The inwardly facing restraining surfaces 134 are designed to engage the outwardly facing restraining surfaces 136 of a similar hose storage device when the hose storage device 10 is stacked in an offset nesting arrangement on top of a similar hose storage device. Likewise, the outwardly facing restraining surfaces 136 are designed to engage the inwardly facing restraining surfaces 134 of a similar hose storage device stacked in an offset nesting relation on top of the hose storage device 10. The outwardly facing restraining surfaces 136 in the preferred embodiment of the present invention are the outwardly facing vertical surfaces in a recess formed in the top of the upper corner structure 28 of each side frame 20 and 22. The outwardly facing restraining surfaces 136 also have the square openings 92 therein that receive the square protrusions 88 of the locking mechanism 86 on the handle structure 14 in order to secure the handle structure 14 in the carrying position. The inwardly facing restraining surfaces 134 are the inwardly facing surfaces of the ridges extending downward from the recess 30 formed in the bottom of each side frame 20 and 22.

To stack a series of hose storage devices 10, the handle structures 14 are folded down to the stacking position. As shown in FIG. 10, the hose storage device 10 is aligned in an offset relation above a similar bottom hose storage device such that when the hose storage device 10 is lowered, one of the recesses 30 formed in the bottom of the side frames 20 and 22 thereof nests on top of one of the upper corner structures 28 of the similar bottom hose storage device. Also, the outwardly facing restraining surfaces 136 and the inwardly facing restraining surfaces 134 located on the nested upper corner structure 28 and recess 30, respectively, are engaged and prevent the hose storage devices from moving in a lateral relation with respect to each other. When a top hose storage device is stacked in an offset nesting arrangement on top of the hose storage device 10, the upwardly facing supporting surfaces 130 of the hose storage device 10 supports the downwardly facing stacking surfaces 132 on the bottom of the similar hose storage device. The circular end flanges 102 and 104 of the hose storage device 10 are closely spaced below the surface of the hose reel structure 16 of the similar hose storage device, and the end flanges 102 and 104 of the hose storage device 10 are closely spaced in an offset relation next to the end flanges 102 and 104 of the similar hose storage device.

Referring now more particularly to FIGS. 12–21, there is shown therein a hose storage cart, generally indicated at 210, according to a second embodiment which embodies the principles of the present invention. The hose storage cart 210 in general comprises a supporting frame structure, generally indicated at 212, a handle structure, generally indicated at 214, and a hose reel structure, generally indicated at 216.

Figure 13:
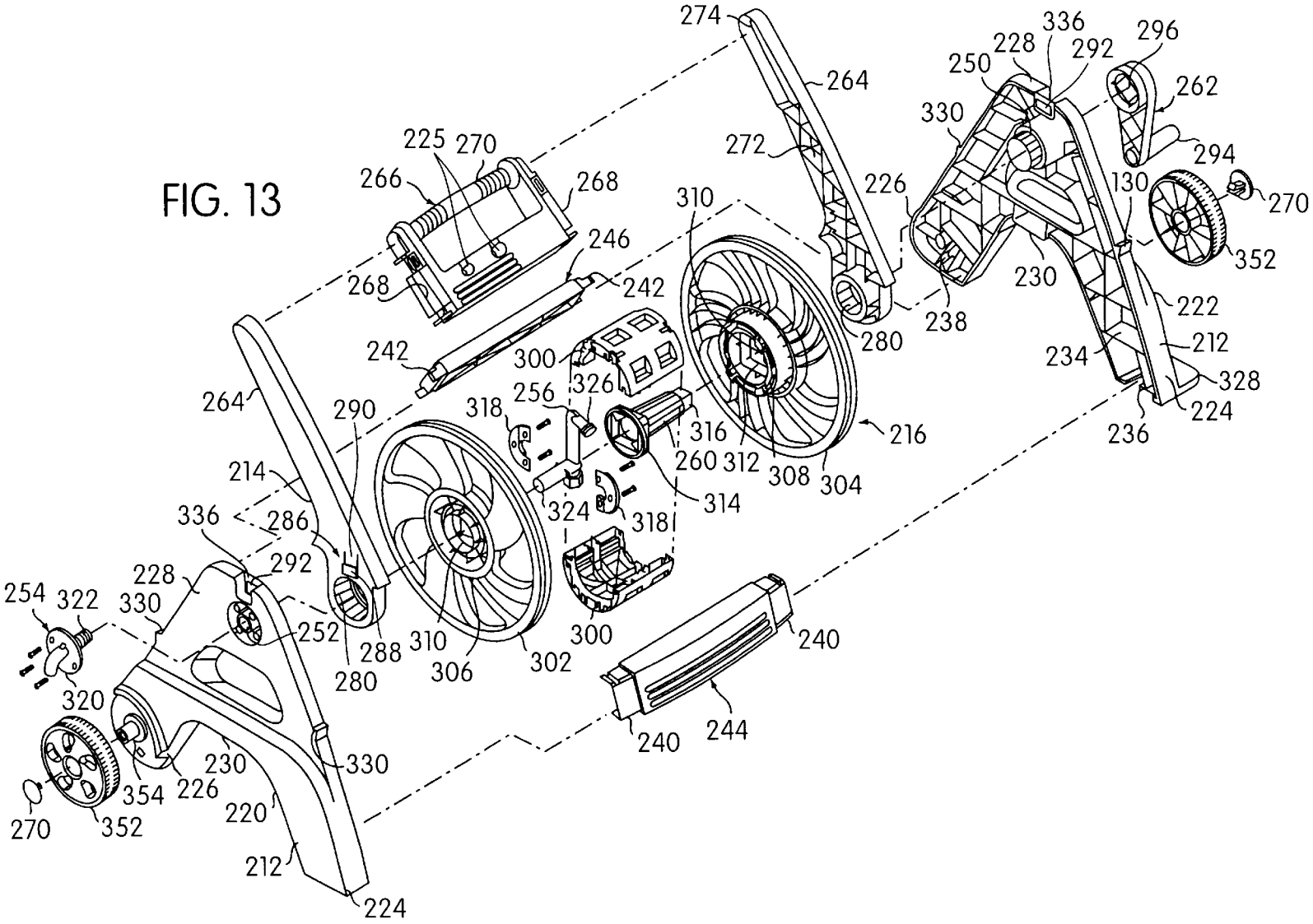
FIG. 13 is an exploded perspective view of the hose storage cart according to the second embodiment of the invention.
Figure 15:
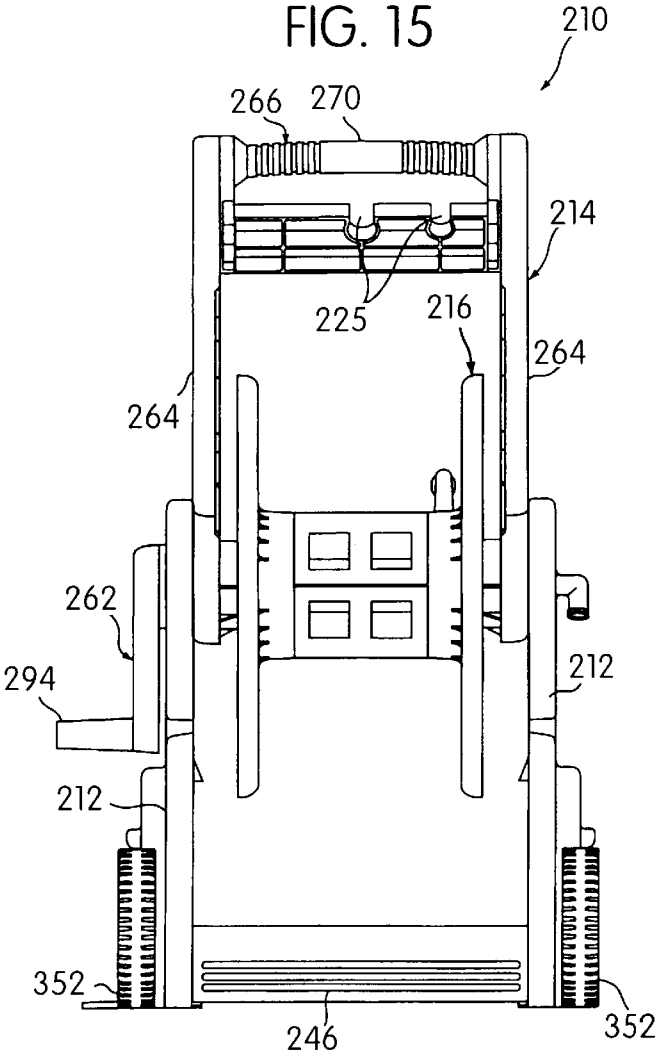
FIG. 15 is a rear elevational view of the hose storage cart according to the second embodiment of the invention.
Figure 14:
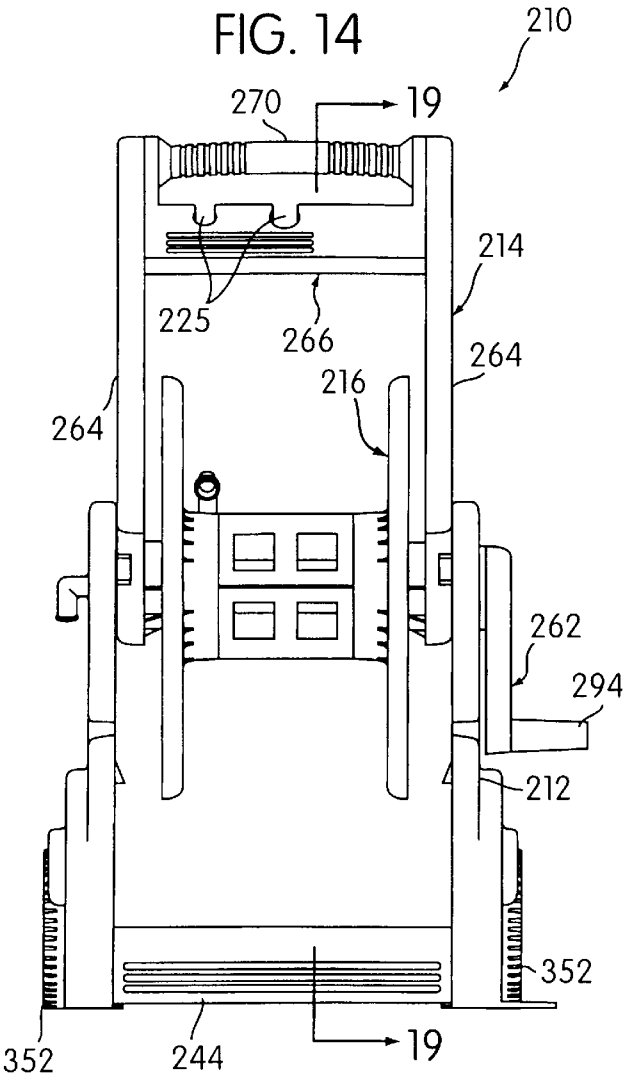
FIG. 14 is a front elevational view of the hose storage cart according to the second embodiment of the invention.

As shown in FIG. 13, the supporting frame structure 212 includes a pair of molded plastic side frame structures 220 and 222 shaped into a generally triangular configuration. This triangular configuration forms in the side frames three corner structures, namely, front corner structure 224, rear corner structure 226, and upper corner structure 228. The side frames 220 and 222 are generally mirror images of each other.

Figure 20:
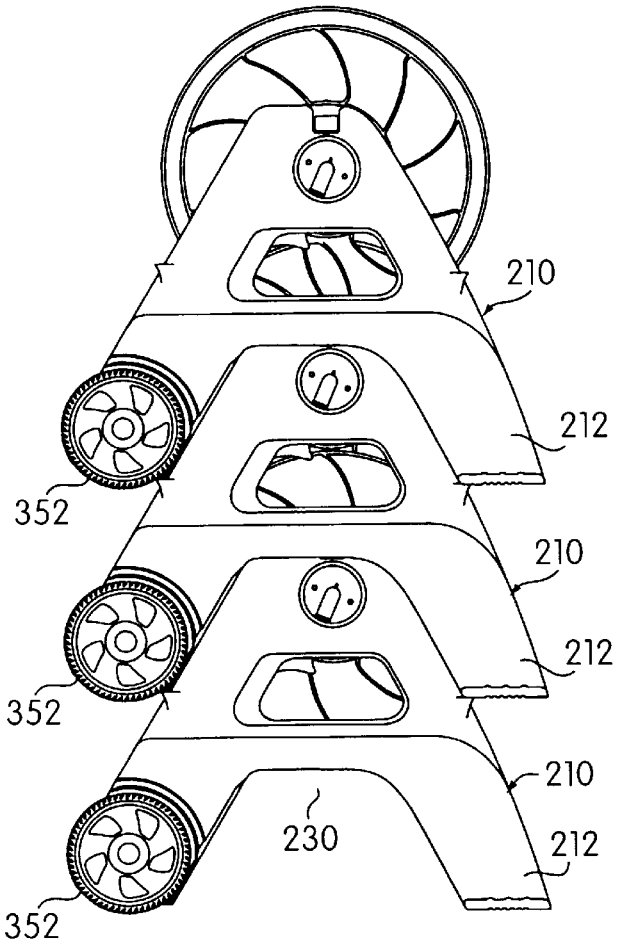
FIG. 20 is a side elevational view showing three hose storage devices according to the second embodiment of the invention stacked in a nesting relation in accordance with the principles of the present invention.
Figure 21:
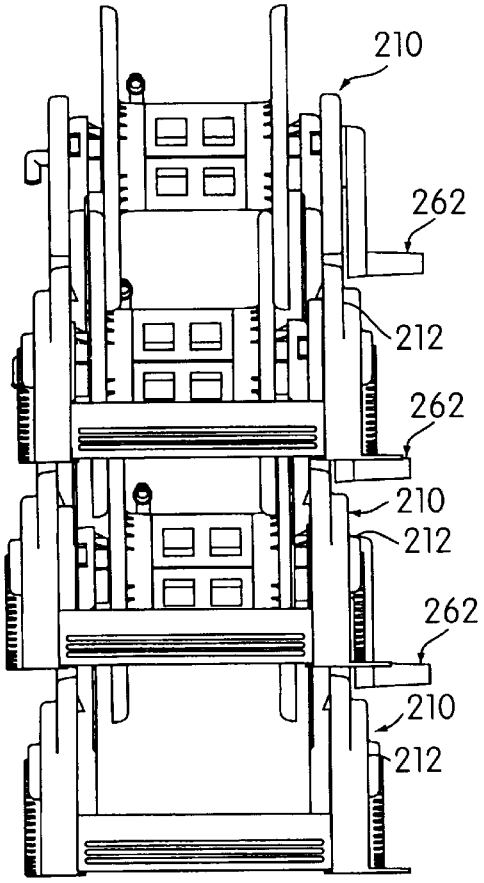
FIG. 21 is a front elevational view showing three hose storage devices according to the second embodiment of the invention stacked in a nesting relation in accordance with the principles of the present invention.

The bottom portion of each side frame 220 and 222, extending from the front corner structure 224 to the rear corner structure 226, has an upward recess 230 in the center. The upward recess 230 is designed to nest upon the upper corner structure 228 of a similar side frame when the hose storage cart 210 is stacked in a nesting relation on top of a similar hose storage cart as shown in FIGS. 20 and 21.

Figure 19:
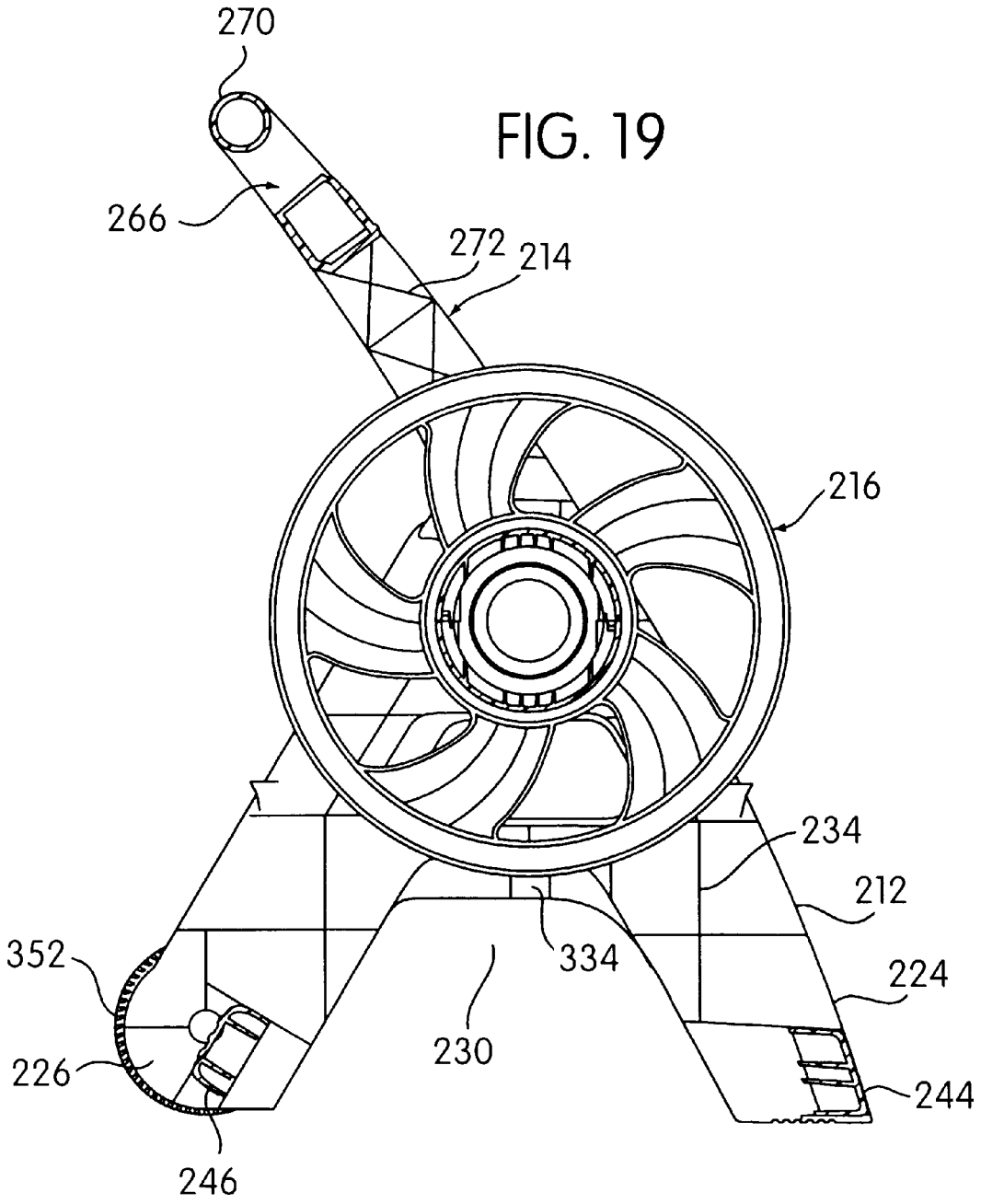
FIG. 19 is a cross-sectional view of the hose storage device according to the second embodiment of the invention taken along the line 19—19 of FIG. 14.

Each of the side frames 220 and 222 have a generally channel-shaped configuration with strengthening ribs 234 on the interior as best shown in FIGS. 13 and 19. The channel-shaped configurations of the side frames 220 and 222 open towards one another.

The front corner structure 224 of each side frame 220 or 222 has a socket structure 236 opening in a direction towards the corresponding socket structure 236 on the other side frame 220 or 222. A socket structure 238 opening in a direction towards a corresponding socket structure 238 on the other side frame 220 or 222 is also found on the rear corner structure 226 of each side frame 220 or 222. The socket structures 236 and 238 on the front and rear corner structures 224 and 226 are designed to receive and fit snugly the insert end portions 240 and 242 of each of two front and rear transverse frame members 244 and 246, respectively.

The transverse frame members 244 and 246 are made of plastic and are formed by injection molding. Injection molding gives the transverse members 244 and 246 center portions with insert end portions 240 and 242. The insert end portions 240 and 242 have grooves extending around their peripheries. The socket structures 236 and 238 have ribs on their interiors. These ribs interlock with the grooves on the insert end portions 240 and 242 of the transverse frame members 244 and 246 when the insert end portions 240 and 242 are inserted into the associated socket structures 236 and 238. When all the insert end portions of the transverse frame members 244 and 246 are retained in a snugly fitting relation with the associated socket structure 236 and 238, the side frames 220 and 222 and the transverse frame members 244 and 246 constitute the supporting frame structure 212.

The hose storage cart includes wheel assemblies. Each wheel assembly comprises a pair of wheels 352 rotatably mounted on respective shafts 354 extending outwardly from each side frame 220 and 222 proximate the rear corner structures 226 thereof. The wheels 352 are preferably made of molded plastic with a hole formed axially through the center allowing them to be rotatably mounted upon the shafts 354. The wheels 352 are retained on the respective shafts 354 by suitable end caps 270 that attach to the ends of the shafts 354. Each shaft 354 is preferably of a hollow cylindrical construction, and each end cap preferably comprises a circular cap with a cylindrical protrusion extending axially from the center thereof. The cylindrical protrusion fits snugly into the hollow center of the shaft, and the cap is attached to the end of the shaft by inserting the protrusion into the hollow center.

As an alternative to the illustrated embodiment, each wheel could be secured to the frame structure 212 by any conventional means, such as, a bolt-washer-nut arrangement.

The inner surface of each side frame 220 or 222 has a hub 250 designed to rotatably support the hose reel structure 216 and the handle structure 214 connected therewith to the supporting frame structure 212. The hub 250 on the inlet-side side frame 220 has a hole 252 through which a water inlet pipe 254 can be rotatably and fluidly connected to a water outlet pipe 256 carried by the hose reel structure 216. The crank-side side frame 222 has a hole through which a rotatable shaft 260 can engage the hose reel structure 216 and the hand crank structure 262.

The handle structure 214 includes side legs 264 and a transverse member 266. The transverse member 266 is formed of plastic by injection molding. Injection molding gives the transverse handle member 266 a center portion with closed end portions 268. The transverse handle member 266 also has a hand grip portion 270 formed by molding a pattern into the plastic in order to facilitate gripping.

The side legs 264 are made of plastic and have a generally channel-shaped configuration with strengthening ribs 272 on the interior. The side legs 264 have socket structures 274 on the inside surface. The closed end portions 268 of the transverse member 266 are retained in a snugly fitting relation with the socket structures 274 located on the inside surface of the side legs 264.

A circular ring 280 is formed integral with the bottom of each side leg 264. The circular rings 280 are designed to fit onto the hubs 250 extending inward from the side frames 220 and 222 and be retained thereon by end flanges 302 and 304 of the hose reel structure 216. In this way, the handle structure 214 is movably connected to the supporting frame structure 212. The handle structure 214 is movable from a stacking position extending generally downward coextensive with the supporting frame structure 212 to an upright position extending upward from the supporting frame structure 212, so that the hand grip portion 270 is disposed above the supporting frame structure 212.

The side legs 264 also have locking mechanisms 286 located thereon. Each locking mechanism 286 is a tab 290 formed integrally within the outwardly facing wall of the side leg 264 with a square protrusion 288 extending outward from the tab 290. A square opening 292 is located on the top of each side frame 220 and 222. Each square opening 292 is on an outwardly facing restraining surface 336 at the upper corner 228 of the side frames 220 and 222. The square protrusions 288 engage the side frame 220 and 222 as the handle structure 214 is rotated from the stacking position to the carrying position and the locking mechanisms 286 are deflected inward into the side legs 264. When the handle structure 214 reaches the upright position, the square protrusions 288 reach the square openings 292. Each locking mechanism 286 springs back and the square protrusions 288 fit within the square openings 292. In this way, the handle structure 214 is secured in the upright position by the locking mechanisms 286. The locking mechanisms 286 are disengaged by pushing the square protrusions 288 out of the square openings 292 such that the locking mechanisms 286 are deflected backwards into the side legs 264. The handle structure 214 can then be rotated down to the stacking position.

A hand crank structure, generally indicated at 262, turns the hose reel structure 216. The molded plastic hand crank structure 262 has a handle 294 and a socket structure 296. The socket structure 296 has a square shape within which the end of a rotatable shaft 260 forming a part of the hose reel structure 216 is received. A fastener may be provided to fix the hand crank structure 262 to the rotatable shaft 260.

Preferably, the hose reel structure 216 utilizes two semi-cylindrical hub sections 300, two circular end flanges 302 and 304, a water outlet pipe 256, a rotatable, fluid connection between the inlet pipe 254 and the outlet pipe 256, and a rotatable shaft 260. It is not necessary that the end flanges 302 and 304 be circular. End flanges with shapes that are generally circular, such as a hexagon or an octagon, are acceptable, although circular end flanges 302 and 304 are preferred. The specific manner in which the hose reel structure is assembled is taught in U.S. Pat. No. 5,007,598, the disclosure of which is hereby incorporated by reference.

The circular end flanges 302 and 304 are made of molded plastic with hub sections 306 and 308 and spokes extending outward to circular rims. The diameter of the circular end flanges 302 and 304 is great enough that when the hose reel structure 216 is rotatably mounted within the supporting frame structure 212, portions of the circular end flanges 302 and 304 are above the highest point of the supporting frame structure 212. A notch on the hub 306 on the inlet-side end flange 302 allows the water outlet pipe 256 to be rotated fixedly with the surface of the hose reel structure 216. The hub 306 of the inlet-side end flange 302 also has a circular opening 310 allowing it to be rotatably mounted on a hub 250 extending inward from the side frame 220. The crank-side end flange 304 has a circular opening 310 in the hub 308 allowing it to be rotatably mounted on a hub 250 extending inward from the side frame 222. The inside of the crank-side end flange 304 has a squared opening 312 designed to receive the squared base 314 of the rotatable shaft 260.

The semi-cylindrical hub sections 300 are made of molded plastic and designed to interlock with each other and form a cylindrical hub section. They are also designed to engage with surfaces of the inside hubs 306 and 308 of the circular end flanges 302 and 304 in order to form the hose reel structure 216. This cylindrical hub section is responsible for bearing the coiled length of hose. In this way, the hose reel structure 216 is designed to be capable of bearing the load of a substantial length of hose and contained water and to have a surface capable of engaging the hose as the hose reel structure 216 is rotated.

A rotatable shaft 260 of molded plastic is used to engage the crank-side circular end flange 304 and the hand crank structure 262, thereby rotating the hose reel structure 216 as the hand crank structure 262 is turned. The rotatable shaft 260 is conical with a square end 316 for engaging the hand crank structure 262 and a square base 314 for engaging the crank-side end flange 304.

The inlet-side end flange 302 is first rotatably mounted on the hub 250 extending inward from the inlet-side side frame 220. The water outlet pipe 256 is rotatably mounted by fluidly connecting it to the water inlet pipe 254 and aligning it in the notch on the inlet-side end flange 302. A two-piece retainer 318, secured by fasteners to the hub 250 extending inward from the inlet-side side frame 220, holds the outlet pipe 256 in connection with the inlet pipe 254. The gasket 318 also secures the inlet-side end flange 302 to the hub 250 extending inward from the side frame 220, but allows the inlet-side end flange 302 to rotate freely.

The two semi-cylindrical hub sections 300 are joined together to form a cylindrical hub section. This cylindrical hub section engages the inlet-side end flange 302 such that the center line of the cylindrical hub section is perpendicular to the end flange 302. The squared base 314 of the rotatable shaft 260 is engaged with the squared opening in the crank-side end flange 304. The crank-side end flange 304, now engaged with the rotatable shaft 260, is joined to the end of the cylindrical hub section. The circular opening 310 on the hub 308 section of the crank side end flange 304 is then mounted on the hub 250 extending inward from the crank-side side frame 222. By engaging the squared end 316 of the rotatable shaft 260 with the squared socket structure 296 of the hand crank 262 and securing it thereto with a fastener 298, the hose reel structure 216 is rotatably mounted within the supporting frame structure 212 with a portion of the circular end flanges 302 and 304 above the highest point of the supporting frame structure 212.

Water flows from a water source through the inlet 254 and outlet pipes 256. The inlet pipe 254 is formed of molded plastic and has a ninety-degree bend near one end and a flange 320 near the bend. The end 322 opposite the bend and flange 320 has o-rings allowing it to create a seal when inserted into the outlet pipe 256. The inlet pipe 254 fits in the hole 252 in the upper corner structure 228 of the inlet-side side frame 220 and extends into the hub 250 on which the hose reel structure 216 is rotatably mounted. Fasteners attaching the flange 320 to the inlet-side side frame 220 secure the inlet pipe 254 in a fixed position. A flexible hose can be secured by a clamp to the end of the inlet pipe 254 with the ninety degree bend. This hose can then be connected to a water supply.

The outlet pipe 256 is mounted in the notch on the inlet-side end flange 302. A receiving end 324 is rotatably and fluidly connected to the inlet pipe 254 by inserting the end 322 of the inlet pipe 254 into the receiving end 324 of the outlet pipe 256. A hose can be connected to the male connector 326 found on the end of the outlet pipe 256. A 90° bend in the outlet pipe 256 allows the receiving end 324 of the outlet pipe 256 to be fluidly and rotatably connected with the inlet pipe 254 while the end with the male connector 326 extends radially from the surface of the hose reel structure 216. This arrangement allows the outlet pipe 256 to rotate fixedly with the hose reel structure 216 surface. The outlet pipe 256 also bends near the end with the male connector 326 to facilitate connection with a hose.

A platform 328 integral with the bottom of the side frame 222 extends outward from the front corner structure 224 on the crank-side side frame 222. A user can place his foot on the platform 328 while turning the hand crank structure 262 in order to keep the bottom of the hose storage cart 210 engaged with the ground.

In the presently preferred embodiment of the invention, upwardly facing supporting surfaces 330 are located on the front and back edges of each side frame 220 and 222. The upwardly facing supporting surfaces 330 are aligned horizontally, are disposed below the axis of rotation of the reel assembly 216, and are in the form of ridges extending from and integrally formed with the side frames 220 and 222. The upwardly facing surfaces 330 are aligned such that they support the weight of a similar hose storage cart 210 stacked in an offset nesting arrangement on top of the hose storage cart 210 as shown in FIG. 21.

Figure 16:
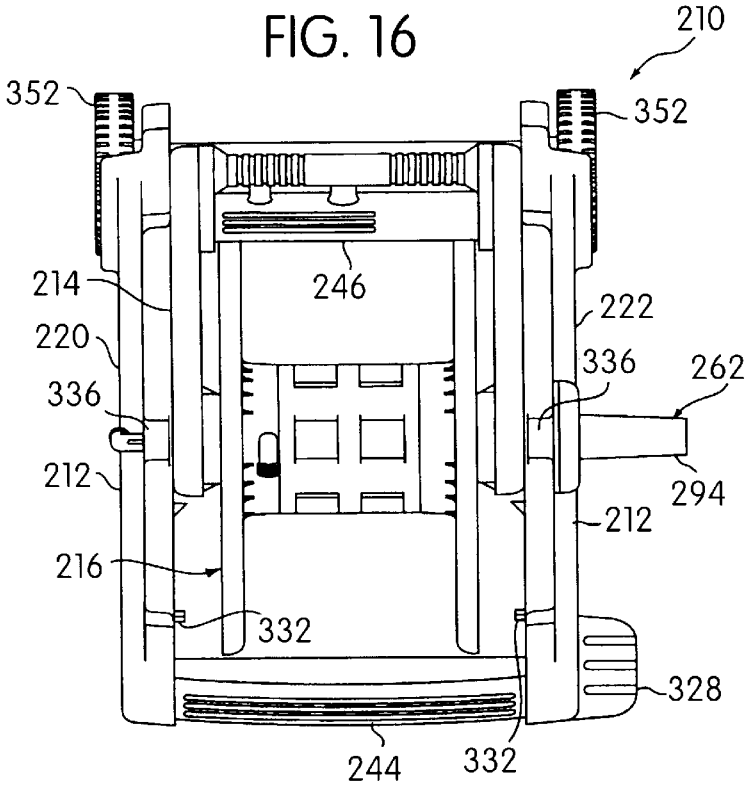
FIG. 16 is a top plan view of the hose storage device according to the second embodiment of the invention.
Figure 17:
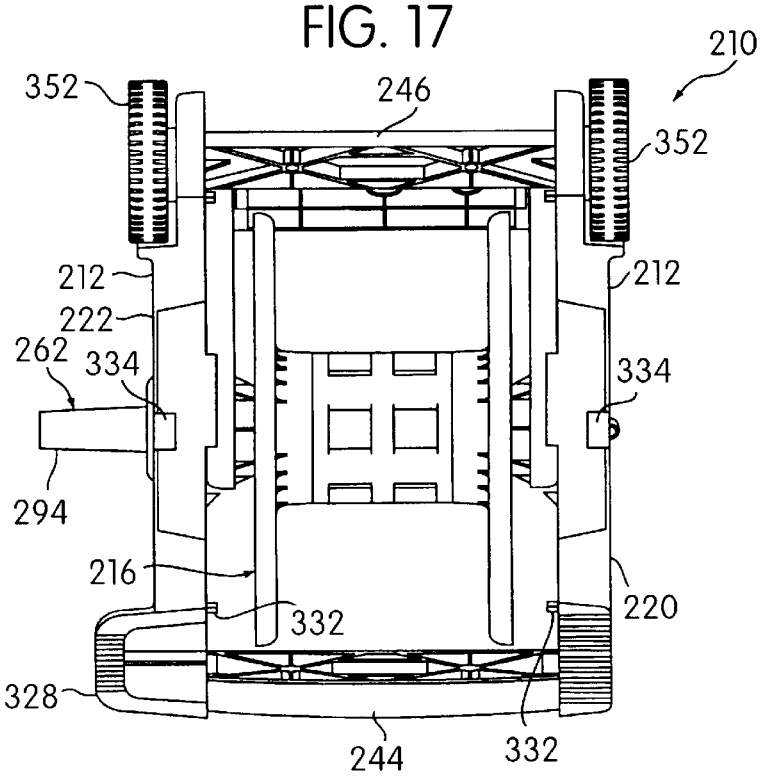
FIG. 17 is a bottom plan view of the hose storage device according to the second embodiment of the invention.
Figure 18:
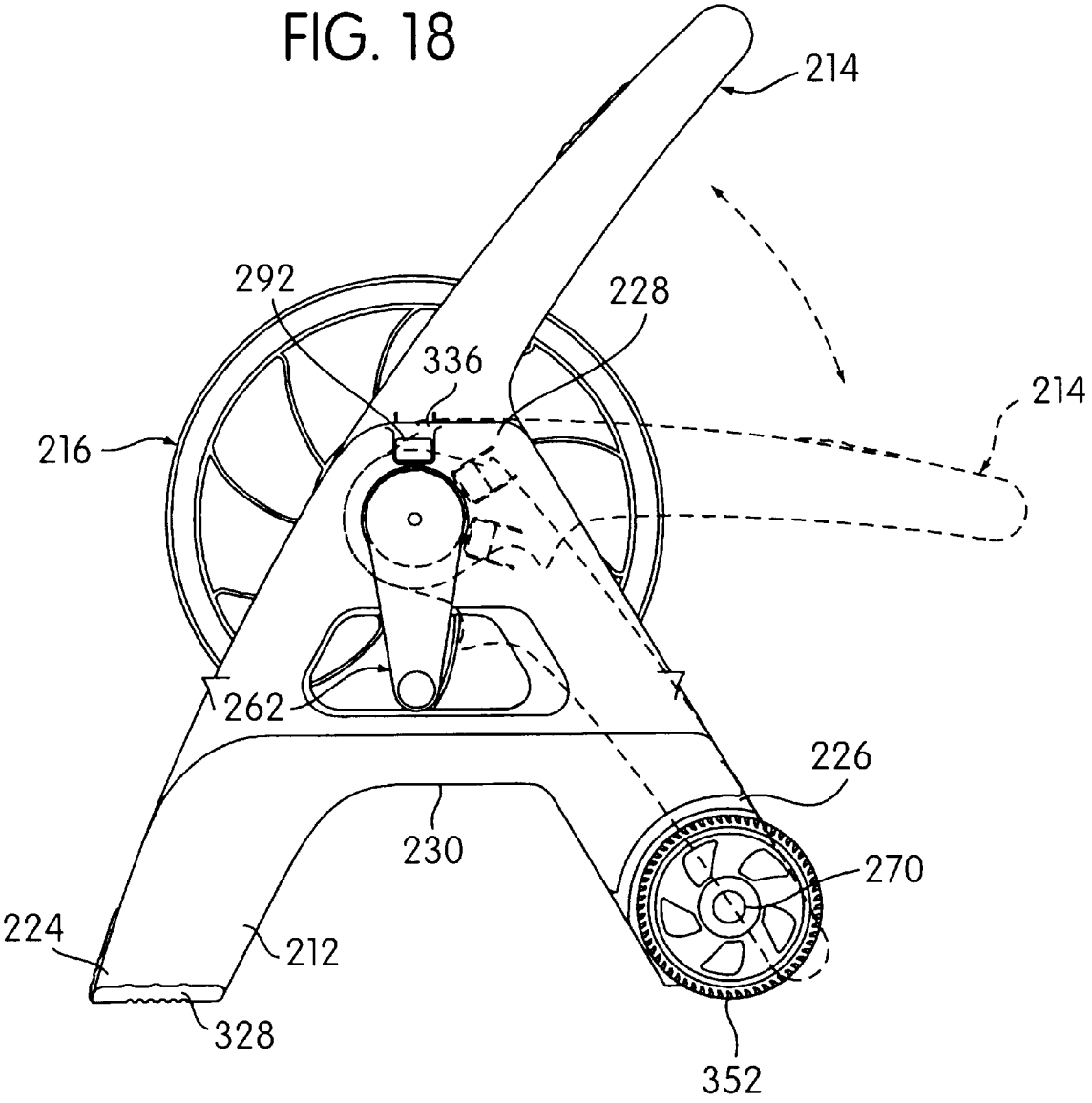
FIG. 18 is a side elevational view of the hose storage device according to the second embodiment of the invention viewed toward the left side with the hand crank structure.

The supporting frame structure 212 also includes downwardly facing stacking surfaces 332 which, as shown, are those surfaces on the bottom of the hose storage cart 210 that rest on the upwardly facing supporting surfaces 330 of a similar hose storage cart when the hose storage cart 210 is stacked in an offset nesting arrangement on top of the similar hose storage cart. As best shown in FIGS. 16 and 17, these downwardly facing stacking surfaces 332 also extend inward from the side frames 220 and 222. When the hose storage cart 210 is stacked in an offset nesting arrangement on top of a similar hose storage cart, as shown in FIGS. 20 and 21, the portions of the downwardly facing stacking surfaces 332 extending inward from one side frame 222 are supported by the upwardly facing supporting surfaces 330 of the similar hose storage cart. Therefore, it is preferable that the downwardly facing stacking surfaces 332 and the upwardly facing supporting surfaces 330 be substantially vertically aligned with each other. Also, the portions of the downwardly facing stacking surfaces 332 that do not extend inward from the other side frame 220 are similarly supported by the upwardly facing supporting surfaces 330 of the similar hose storage cart.

Preferably, the hose storage cart 210 has inwardly facing restraining structures 334 and outwardly facing restraining surfaces 336. The purpose of the inwardly and outwardly facing restraining surfaces 334 and 336 is to restrict lateral movement of the hose storage cart 210 when it is stacked in an offset nesting arrangement on top of or below similar hose storage carts. The inwardly facing restraining structures 334 are designed to engage the outwardly facing restraining surfaces 336 of a similar hose storage cart when the hose storage cart 210 is stacked in an offset nesting arrangement on top of a similar hose storage cart. Likewise, the outwardly facing restraining surfaces 336 are designed to engage the inwardly facing restraining structures 334 of a similar hose storage cart stacked in an offset nesting relation on top of the hose storage cart 210. The outwardly facing restraining surfaces 336 in the preferred embodiment of the present invention are the outwardly facing vertical surfaces in a recess formed in the top of the upper corner structure 228 of each side frame 220 and 222. The outwardly facing restraining surfaces 336 also have the square openings 292 therein that receive the square protrusions 288 of the locking mechanism 286 on the handle structure 214 in order to secure the handle structure 214 in the carrying position. The inwardly facing restraining structures 334 are the inwardly facing surfaces of the ridges extending downward from the recess 230 formed in the bottom of each side frame 220 and 222.

To stack a series of hose storage carts 210, the handle structures 214 are folded down to the stacking position. As shown in FIG. 21, the hose storage cart 210 is aligned in an offset relation above a similar bottom hose storage cart such that when the hose storage cart 210 is lowered, one of the recesses 230 formed in the bottom of the side frames 220 and 222 thereof nests on top of one of the upper corner structures 228 of the similar bottom hose storage cart. Also, the outwardly facing restraining surfaces 336 and the inwardly facing restraining structure 334 located on the nested upper corner structure 228 and recess 230, respectively, are engaged and prevent the hose storage carts from moving in a lateral relation with respect to each other. When a top hose storage cart is stacked in an offset nesting arrangement on top of the hose storage cart 210, the upwardly facing supporting surfaces 330 of the hose storage cart 210 supports the downwardly facing stacking surfaces 332 on the bottom of the similar hose storage cart. The circular end flanges 302 and 304 of the hose storage cart 210 are closely spaced below the surface of the hose reel structure 216 of the similar hose storage cart, and the end flanges 302 and 304 of the hose storage cart 210 are closely spaced in an offset relation next to the end flanges 302 and 304 of the similar hose storage cart.

Any United States patent applications or patents mentioned or cited hereinabove are hereby incorporated by reference into the present specification.

It will thus be seen that the objects of this invention have been fully and effectively accomplished. It will be realized, however, that the foregoing preferred specific embodiments have been shown and described for the purpose of illustrating the functional and structural principles of this invention and is subject to change without departure from such principles. Therefore this invention includes all modifications encompassed within the spirit and scope of the above disclosure.

What is claimed:

1. A hose storage device comprising a supporting frame structure;

said supporting frame structure being constructed and arranged (1) to be nested on top of a similar supporting frame structure and (2) such that a similar supporting frame structure can be nested on top of said supporting frame structure;

a hose reel structure having a hub structure constructed and arranged to receive a length of hose coiled thereon;

said hose reel structure having generally circular end flanges on opposite sides of said hub structure;

said hose reel structure being rotatably mounted on said supporting frame structure;

said structures having upwardly facing supporting surfaces constructed and arranged to support a similar hose storage device stacked on top of said hose storage device in a nesting relation wherein a similar supporting frame structure of the similar hose storage device nests on said supporting frame structure and upper portions of said circular end flanges are disposed in transversely offset and overlapped relation with lower portions of similar generally circular end flanges of the similar hose storage device;

said structures having downwardly facing stacking surfaces constructed and arranged to engage similar upwardly facing supporting surfaces of a similar hose storage device when said hose storage device is stacked on top of the similar hose storage device in a nesting relation wherein said supporting frame structure nests on the similar supporting frame structure of the similar hose storage device and lower portions of said circular end flanges are disposed in transversely offset and overlapped relation with upper portions of similar generally circular end flanges of the similar hose storage device.

2. A hose storage device as defined in claim 1 wherein said supporting frame structure has inwardly facing restraining surfaces and outwardly facing restraining surfaces, said inwardly facing restraining surfaces being constructed and arranged to engage outwardly facing restraining surfaces of a similar hose storage device to prevent lateral movement of said hose storage device when said hose storage device is stacked in the aforesaid nesting relation on top of the similar hose storage device, said outwardly facing restraining surfaces being constructed and arranged to engage inwardly facing restraining surfaces of a similar hose storage device to prevent lateral movement of the similar hose storage device when the similar hose storage device is stacked in the aforesaid nesting relation on top of said hose storage device.

3. A hose storage device as defined in claim 2 wherein said outwardly facing restraining surfaces are outwardly facing vertical surfaces of recessed portions of said supporting frame structure located at a top portion of said supporting frame structure and said inwardly facing restraining surfaces are inwardly facing vertical surfaces on ridges extending downward from recesses formed in the bottom of said supporting frame structure.

4. A hose storage device as defined in claim 1 wherein said hose reel structure is rotatably mounted within said supporting frame structure such that portions of said generally circular end flanges are above the highest point of said supporting frame structure.

5. A hose storage device as defined in claim 1 further comprising:

a water inlet pipe fixed with respect to said supporting frame, a water outlet pipe fixed with respect to said hose reel structure for rotation therewith, one end of said water outlet pipe being fluidly and rotatably connected to one end of said water inlet pipe, said water outlet pipe having a male hose connector on an opposite end thereof constructed and arranged to enable a hose to be connected with said water outlet pipe, said water inlet pipe having a water source connector on an opposite end thereof said water source connector being constructed and arranged to enable said water inlet pipe to be connected to a water source said water inlet pipe, said water outlet pipe, said water source connector, and said male hose connector being constructed and arranged to permit water to flow from the water source to the hose.

6. A hose storage device as defined in claim 1 wherein said hose reel structure has a hand crank structure disposed exteriorly of one side of said supporting frame structure, said hand crank structure being constructed and arranged to enable a manual turning of said hand crank structure to rotate said hose reel structure.

7. A hose storage device as defined in claim 1 wherein said supporting frame structure comprises transversely spaced side frame structures and transverse member structures fixedly interconnected between said side frame structures.

8. A hose storage device as defined in claim 1 wherein said structures are made of plastic.

9. A hose storage device as defined in claim 1, wherein said supporting frame structure includes one or more mounting structures, said one or more mounting structures being constructed and arranged to allow said hose storage device to be mounted on a flat, generally vertical surface by fastening said one or more mounting structures to the flat, generally vertical surface.

10. A hose storage device as defined in claim 9 wherein said mounting structures are flat surfaces on the bottom of said supporting frame structure with holes therein such that fasteners may be inserted through said holes and fixed to the flat, generally vertical surface, thereby mounting said hose storage device on the flat, generally vertical surface.

11. A hose storage device as defined in claim 1 further comprising a handle structure movably connected to said supporting frame structure for movement between a stacking position extending generally coextensive with said supporting frame structure when said hose storage device is stacked in aforesaid nesting relation with a similar hose storage device and a carrying position extending upward from said supporting frame structure with a transversely extending hand grip portion thereof disposed above the hose reel structure.

12. A hose storage device as defined in claim 11 further comprising a locking mechanism constructed and arranged to secure said handle structure in said carrying position.

13. A hose storage device as defined in claim 1 further comprising:

a handle structure movably connected to said supporting frame structure for movement between a stacking position extending generally coextensive with said supporting frame structure when said hose storage device is stacked in aforesaid nesting relation with a similar hose storage device and a operating position extending upward from said supporting frame structure with a transversely extending hand grip portion thereof disposed above the hose reel structure, and wheel structures connected to said supporting frame structure, said wheel structures being constructed and arranged to enable said hose storage device to be rolled manually by exerting force on said hand grip portion of said handle structure in said operating position.

14. A hose storage device as defined in claim 13 wherein said supporting frame structure has inwardly facing restraining surfaces and outwardly facing restraining surfaces, said inwardly facing restraining surfaces being constructed and arranged to engage outwardly facing restraining surfaces of a similar hose storage device to prevent lateral movement of said hose storage device when said hose storage device is stacked in the aforesaid nesting relation on top of the similar hose storage device, said outwardly facing restraining surfaces being constructed and arranged to engage inwardly facing restraining surfaces of a similar hose storage device to prevent lateral movement of the similar hose storage device when the similar hose storage device is stacked in the aforesaid nesting relation on top of said hose storage device.

15. A hose storage device as defined in claim 14 wherein said outwardly facing restraining surfaces are outwardly facing vertical surfaces of recessed portions of said supporting frame structure located at a top portion of said supporting frame structure and said inwardly facing restraining surfaces are inwardly facing vertical surfaces on ridges extending downward from recesses formed in the bottom of said supporting frame structure.

16. A hose storage device as defined in claim 13 wherein said hose reel structure is rotatably mounted within said supporting frame structure such that portions of said generally circular end flanges are above the highest point of said supporting frame structure.

17. A hose storage device as defined in claim 13 further comprising:

a water inlet pipe fixed with respect to said supporting frame, a water outlet pipe fixed with respect to said hose reel structure for rotation therewith, one end of said water outlet pipe being fluidly and rotatably connected to one end of said water inlet pipe, said water outlet pipe having a male hose connector on an opposite end thereof constructed and arranged to enable a hose to be connected with said water outlet pipe, said water inlet pipe having a water source connector on an opposite end thereof said water source connector being constructed and arranged to enable said water inlet pipe to be connected to a water source said water inlet pipe, said water outlet pipe, said water source connector, and said male hose connector being constructed and arranged to permit water to flow from the water source to the hose.

18. A hose storage device as defined in claim 13 wherein said hose reel structure has a hand crank structure disposed exteriorly of one side of said supporting frame structure, said hand crank structure being constructed and arranged to enable a manual turning of said hand crank structure to rotate said hose reel structure.

19. A hose storage device as defined in claim 13 wherein said supporting frame structure comprises transversely spaced side frame structures and transverse member structures fixedly interconnected between said side frame structures.

20. A hose storage device as defined in claim 13 wherein said structures are made of plastic.

21. A hose storage device as defined in claim 13 further comprising a tray structure, said tray structure being constructed and arranged to accommodate the carriage of items used in gardening and lawn care.

22. A hose storage device according to claim 21 wherein said tray structure is mounted lower than said generally circular end flanges.

23. A hose storage device according to claim 21 wherein said tray structure has perforations configured to allow water to drain therefrom.

24. A hose storage device as defined in claim 1, wherein said supporting frame structure has ridges defining said upwardly facing supporting surfaces, said ridges being positioned such that downwardly facing stacking surfaces of a similar hose storage device engage said ridges when the similar hose storage device is stacked on top of said hose storage device.

* * * * *